US006405869B1

(12) United States Patent
Whittemore et al.

(10) Patent No.: US 6,405,869 B1
(45) Date of Patent: Jun. 18, 2002

(54) SHRINK WRAP GIFT BAG AND METHOD OF MANUFACTURING THE SAME

(75) Inventors: Alan W. Whittemore, Riverside, RI (US); Richard J. Ponzo, Mystic, CT (US)

(73) Assignee: 2Wit, LLC, Providence, RI (US)

( * ) Notice: Subject to any disclaimer, the term of this patent is extended or adjusted under 35 U.S.C. 154(b) by 0 days.

(21) Appl. No.: 09/346,226

(22) Filed: Jul. 1, 1999

(51) Int. Cl.[7] ..... B65D 65/38; B65D 33/24

(52) U.S. Cl. ..... 206/497; 229/923; 383/86; 383/908

(58) Field of Search ..... 206/497; 428/35.1; 383/86, 105, 118, 908; 279/923

(56) References Cited

U.S. PATENT DOCUMENTS

| | | | | |
|---|---|---|---|---|
| 3,420,433 A | * | 1/1969 | Bostwick | 383/86 X |
| 3,483,965 A | | 12/1969 | Rosenblatt et al. | |
| 3,625,348 A | * | 12/1971 | Titchenal et al. | 383/109 X |
| 3,650,775 A | * | 3/1972 | Simon et al. | 383/127 X |
| 4,188,443 A | * | 2/1980 | Mueller et al. | 206/497 X |
| 4,555,025 A | | 11/1985 | Weinberg et al. | |
| 4,815,603 A | | 3/1989 | Harris | |
| 4,941,572 A | | 7/1990 | Harris | |
| 5,048,687 A | | 9/1991 | Suzuki et al. | |
| 5,097,955 A | | 3/1992 | Kluter et al. | |
| 5,186,988 A | | 2/1993 | Dixon | |
| 5,209,349 A | | 5/1993 | Porter et al. | |
| 5,491,017 A | | 2/1996 | Todt | |
| 5,518,119 A | | 5/1996 | Takahashi | |
| H9 H | * | 1/1986 | Ashmore | 206/497 |

* cited by examiner

*Primary Examiner*—Bryon P. Gehman
(74) *Attorney, Agent, or Firm*—Barlow, Josephs & Holmes, Ltd.

(57) ABSTRACT

A heat shrinkable gift bag is configured for at-home shrink wrapping of gift boxes using a home hair dryer. The gift bag consists of a monolithic sheet of heat shrinkable plastic film formed into an envelope style bag. The plastic film is a PVC-based film having a heat activation range in the heat range of a hair dryer. The film has a gauge thickness of about 80–100 gauge, and further has a 30—30 balanced shrink ratio to provide uniform shrinkage upon the application of heat. The plastic film is converted into a side-weld type bag having a rear bag panel and a front bag panel, the front bag panel being shorter than the rear bag panel to provide a lip. The front and rear bag panels are welded along opposing side edges thereof. In order to provide tight engagement of the box to be wrapped, the dimensions of the bag are preferably about 10–15% larger than the dimensions of the box. A self-adhesive strip is disposed on the lip of the bag to close the bag. The outer surface of the plastic film has a central printed area and narrow border strips extending along opposing side edges of the central printed area. The border strips are not printed to prevent the printing inks from melting and sticking to the seal bars upon welding.

4 Claims, 6 Drawing Sheets

SHRINK WRAP GIFT BAG AND METHOD OF MANUFACTURING THE SAME

BACKGROUND AND SUMMARY OF THE INVENTION

The instant invention relates to shrink wrap packaging, and more specifically to shrink wrap gift bags configured, arranged and manufactured for standard gift boxes so that upon the application of heat from a conventional hair dryer, or similar heat source, the packaging neatly conforms to the box configuration and results in an aesthetically appealing outer wrapping.

Gift wrapping for holidays and other gift giving events can be stressful, time consuming, and expensive. Accordingly, there have been a number of attempts to introduce alternative wrapping methods to save time and money. For example, the use of paper gift bags has become common when the gift does not have to be mailed or otherwise concealed for an extended period of time. In any event, it is believed by the Applicants that shrink wrap gift bags configured to closely resemble actual paper wrapping could be an acceptable, even desirable, alternative to conventional paper wrapping in gift giving circumstances. For example, shrink wrap gift bags might be a speedy and inexpensive alternative for gift wrapping services in malls, or may be a preferred alternative for individuals and companies that send gift boxes through the mail.

In general, heat shrink wrapping is well known in the packaging art. Heat shrink wrappings are commonly used in industrial and commercial applications for the packaging of boxes that are to be sold at retail. For example, see the US patent to Suzuki U.S. Pat. No. 5,048,687. In commercial applications such as in the Suzuki patent, shrink wrap is applied to the boxes by machines that are specifically configured for wrapping the subject box, cutting and heat sealing the edges of the material and then applying heat to shrink the material to conform to the box. The materials and devices utilized in these processes are unsuitable for application to the home market.

Heat shrink wrapping has also been introduced to the retail market for custom wrapping of odd shaped articles, such as fruit baskets, and other food items, etc. For example, the U.S. Patent to Harris U.S. Pat. No. 4,815,603 discloses a method of wrapping a fruit basket, the U.S. Patent to Harris U.S. Pat. No. 4,941,572 discloses a method of wrapping flowers for shipment, and the U.S. Patent to Weinberg et al U.S. Pat. No. 4,555,025 discloses a bag construction for a vacuum form shrink bag with an integral carrying handle for packaging food products.

There has also been an attempt to introduce plastic wrap packaging to the at-home market for use in the wrapping of gifts. In this regard, the U.S. patent to Dixon U.S. Pat. No. 5,186,988 represents the closest prior art to the subject matter of the present invention of which the applicant is currently aware. The U.S. Patent to Dixon discloses a gift wrapping bag or envelope formed from sheets of a plastic material. The preferred embodiment as disclosed in Dixon provides the gift bags in a roll wherein individual bags can be torn from the roll for use, similar to a roll of plastic garbage bags. Intermediate tear strips are provided within the roll for use as closure ties. The disclosure further indicates that "corner portions of the bags may be formed from a heat shrinkable material" to provide a snug fit around multi-cornered boxes. Although the Dixon patent is a good example of the general concept, there are several design flaws in the actual construction of the bag which have likely prevented the concept from being realized commercially. The first perceived flaw is that it is extremely difficult, if not impossible, for plastic sheets to be formed with areas thereof having different formulations to provide shrink wrapping only in those designated areas. Secondly, because the bags are not completely formed from shrink wrap plastic, the finished wrapping likely will not conform to the actual shape of the article and therefore may not be entirely aesthetically appealing. In addition, tear strip closures do not provide a neat and tidy closure when wrapping conventional square boxes. It is also believed that shrink wrapping only certain portions of the box would result in distortion of any decorative indicia printed on the plastic, resulting in skewed or deformed decorative pictures, which again would detract from the aesthetic or decorative look of the finished wrapping. Another manufacturing drawback to the disclosed embodiments is the preference to have the tear strips formed from a woven material. Again, it is believed that it would be difficult, if not impossible, to form the perforated tear strips from another type of material.

While the Dixon patent is evidence of a prior attempt to produce a domestic plastic gift bag system, market research and study has shown that such products utilizing the Dixon patent are not available on the market. Accordingly, there is a need for a shrink wrap product for at-home shrink wrapping.

The instant invention provides an improved heat shrinkable gift bag that is specifically configured and arranged for simple and effective at-home shrink wrapping of gift boxes using a home hair dryer. The gift bag consists of a monolithic sheet of heat shrinkable plastic film formed into a side-weld envelope style bag. The plastic film preferably has a gauge thickness of about 80–100 gauge and further has a shrink ratio in both x and y orientations of the film balanced according to bag size and function to provide a uniform and consistent shrink profile upon the application of heat thereto. The plastic film is formed into a side-weld type bag wherein the inner surface of the plastic film is folded over on itself along a transverse line to define a rear bag panel and a front bag panel, the front bag panel being shorter that the rear bag panel to thereby form an extended lip for closure of the bag. The front and rear bag panels are welded along opposing side edges thereof thereby providing a closed bottom end, closed side edges and an open top end forming a lipped mouth of the gift bag. A self-adhesive strip is disposed on the extended lip for use in sealing the mouth of the bag closed. The outer surface of the plastic film may have a central printed area extending in a longitudinal strip along the length of the film. The plastic film is preferably provided in an opaque color, such as white, and may then be over printed with decorative patterns and indicia, such as holiday or special occasion patterns, to simulate conventional wrapping material. To facilitate welding of the side edges of the bag during manufacture, the extreme side edge of the outer surface is best left un-printed, leaving narrow border strips along opposing side edges of the central printed area which are devoid of any printed indicia. The absence of any printing inks along the weld line allows the use of less expensive seal bars inasmuch as the inks will not melt and stick to the seal bars. The un-printed border strips are of minimal width so that un-printed areas adjacent to the weld lines of the bag are minimized.

To maximize effectiveness in providing a wrapping system which is easy to use and which provides a superior finished look, bags are manufactured in sizes which are only slightly larger than the boxes for which they will be used to wrap. As a general rule, the Applicants have found that the dimensions of the bag should not be any more than 20% larger than the dimensions of the box, and preferably not more than 10% larger. Proper dimensioning of the bags will permit a loose accommodation of the box when first inserted, and then snugly and tightly engage the box when shrunk.

Accordingly, among the objects of the instant invention are:

(1) the provision of a shrink wrap gift bag that is specifically configured, sized and manufactured so that the bag closely conforms to the box when shrunk;

(2) the provision of such a shrink wrap gift bag wherein the bag is configured in the shape of an envelope with an adhesive backed lip closure;

(3) the provision of such a shrink wrap gift bag wherein the shrink wrap plastic utilized is of the type that is activated within the heat range of a typical home hair dryer; and (4) the provision of such a shrink wrap gift bag wherein the plastic is formulated with a shrink ratio balanced for a consistent uniform shrinkage whereby the decorative patterns appear uniform throughout the package after shrinking.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
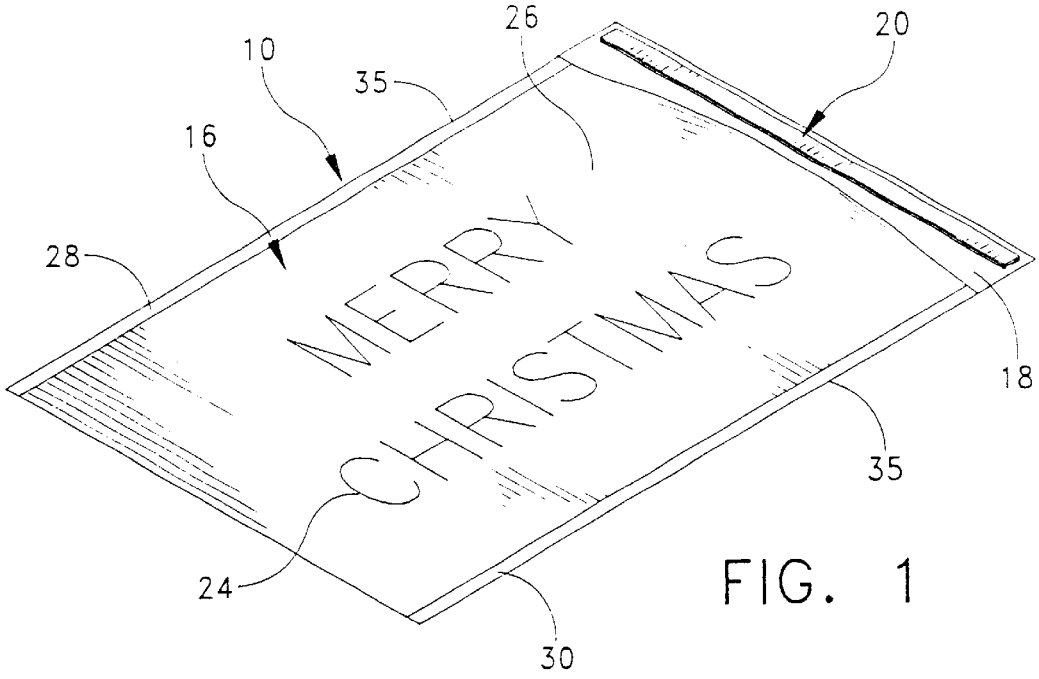
FIG. 1 is a perspective view of a shrink wrap gift bag constructed in accordance with the teachings of the present invention.

Referring now to the drawings, the shrink wrap gift bag of the instant invention is illustrated and generally indicated at 10 in FIGS. 1–12. As will hereinafter be more fully described, the instant invention provides an improved heat shrinkable gift bag 10 that is specifically configured and arranged for simple and effective at-home shrink wrapping of gift boxes using a home hair dryer.

The gift bag 10 comprises of a monolithic sheet of heat shrinkable, flexible plastic film 12 that is converted into a side-weld envelope style bag, having a rear bag panel 14 and a front bag panel 16. The rear bag panel 14 is longer than the front bag panel 16 to form an extended closure lip 18. The closure lip 18 includes a poly-backed self-adhesive strip generally indicated at 20 for closure of the bag 10. While this disclosure specifically discusses the use of a poly-backed adhesive strip 20, it is to be understood that other types of adhesives and adhesive strips are also suitable for purposes of the invention.

In general, the plastic film 12 comprises a flexible, heat shrinkable plastic film having an activated shrink temperature of between about 140° F. to about 195° F. Plastic materials which are suitable for the present application include, but are not limited to, polyethylene, polypropylene, nylon and polyvinyl chloride. The film 12 preferably has a gauge thickness of between about 70 gauge and about 120 gauge. It is also preferable that the plastic film 12 is formulated with a balanced shrink ratio, or balanced orientation, meaning that the plastic shrinks an equal amount in both the x and y (machine and transverse) orientations of the film. The shrink factor is preferably between about 10% to about 40%. The balanced shrink ratio provides a uniform and consistent shrink profile which will not distort any printed indicia or decorative patterns on the plastic film 12 upon the application of heat.

More specifically, the plastic film 12 comprises a polyvinyl chloride plastic film having a gauge thickness of about 80 gauge–100 gauge. The plastic film 12 further has a 30—30 balanced shrink ratio, or in other words, the plastic film will shrink about 30% in both x and y orientations of the film.

Turning to FIGS. 9–12, the sheet of the plastic film 12 is converted into a side-weld type bag 10 using conventional cutting, printing and sealing processes. The sheet of film 12 is first cut to the desired width of the bag 10. The outer surface 22 of the film 12 is then printed with a desired design 24 using solvent based, lamination grade inks. In this regard, the plastic film 12 is preferably provided in an opaque color, such as white, and then over printed with decorative patterns and indicia, such as holiday or special occasion patterns, to simulate conventional wrapping material. A white background generally gives the inks a brighter appearance. The inks are transferred to the film 12 using a conventional flexographic printing process with rubber or photopolymer printing plates. It is important to note that printing of the sheet is done only in a central printed area 26 extending in a longitudinal strip along the length of the film 12. The extreme side edges of the outer surface 22 are not printed, leaving narrow border strips 28, 30 along opposing side edges of the central printed area 26 which are devoid of any printed indicia. The absence of any printing inks in these border strips 28, 30 allows the use of less expensive seal bars, prevents the prevents the inks from melting and sticking to the seal bars, and generally facilitates welding of the side edges of the bag during manufacture. As long as the border strips 28, 30 are not too wide, the appearance of the borders will be minimized upon shrinkage of the bag 10 so that there very little un-printed areas adjacent to the weld lines of the bag. These border strips 28, 30 are approximately ⅛ to ½ inch wide, and more preferably about ¼ inch wide.

After printing, the sheets of film 12 are loaded onto rolls and processed through a side-weld bag forming machine. More specifically, the inner surface 32 of the plastic film 12 is folded over on itself along a transverse line 34 (shown in broken line) to define the rear bag panel 14 and a front bag panel 16, the front bag 16 panel being shorter that the rear bag panel to form the extended lip 18. The lip 18 should not be more than 2 inches long, and is preferably tapered or chamfered at the terminal corners. The front and rear bag panels 14, 16 are then welded along opposing side edges thereof forming side seams 35 to provide a closed bottom end, closed side edges and an open top end forming a mouth of the gift bag 10. The non-shrinkable self-adhesive strip 20 is then disposed on the extended lip 18 of the rear bag panel 14 for use in sealing the mouth of the bag closed. The adhesive strip 20 comprises a thin film of self-adhesive material 20*b* backed by a poly release strip 20*a* which is removed at the time of use to expose the adhesive material beneath. The adhesive material 20*b* may comprise any self-adhesive material which is not subject to shrinkage upon the application of heat. It is preferable that the self-adhesive strip does not shrink so as to maintain a neat, unbuckled appearance in the finished product. Suitable tape strips 20 are commercially available, such as 3M brand closure tape HKC-71 (reclosable poly-backed strip). The above-noted methodology represents only a single example of the manner in which the bag 10 may be formed. Other side welding machines operate in different manners and are equally suitable for the present task. For example, another side weld machine continuously folds the sheet of material along a longitudinal fold line and forms the side welds transversely across the sheet. In this regard, the un-printed border strips would extend laterally across the sheet, and the seal bars would strike the folded sheet along the un-printed border areas. These side welds sever individual bags from the folded sheet with the trailing side edge of one bag formed the leading side edge of the next. It is therefore to be understood that the scope of the invention is not to be limited in the manner in which the bags are formed. To be truly effective in providing a wrapping system which is easy to use and which provides a superior finished look, the bags 10 must be manufactured in sizes appropriate for the boxes for which they will be used to wrap. As a general rule, the Applicants have found that the dimensions of the bag 10 should generally be not more than 20% larger than the dimensions of the box, and preferably not more than 10–15% larger. Proper dimensioning of the bag 10 will permit a loose accommodation of the box when first inserted, and then snugly and tightly engage the box when shrunk. For example, for a candy box having dimensions of approximately 10 inches by 17 inches by 1 inch, the bag should be approximately 11.5 inches wide by 18.5 inches long, the extra width and length of the flat bag accommodating the thickness of the box.

Figure 2:
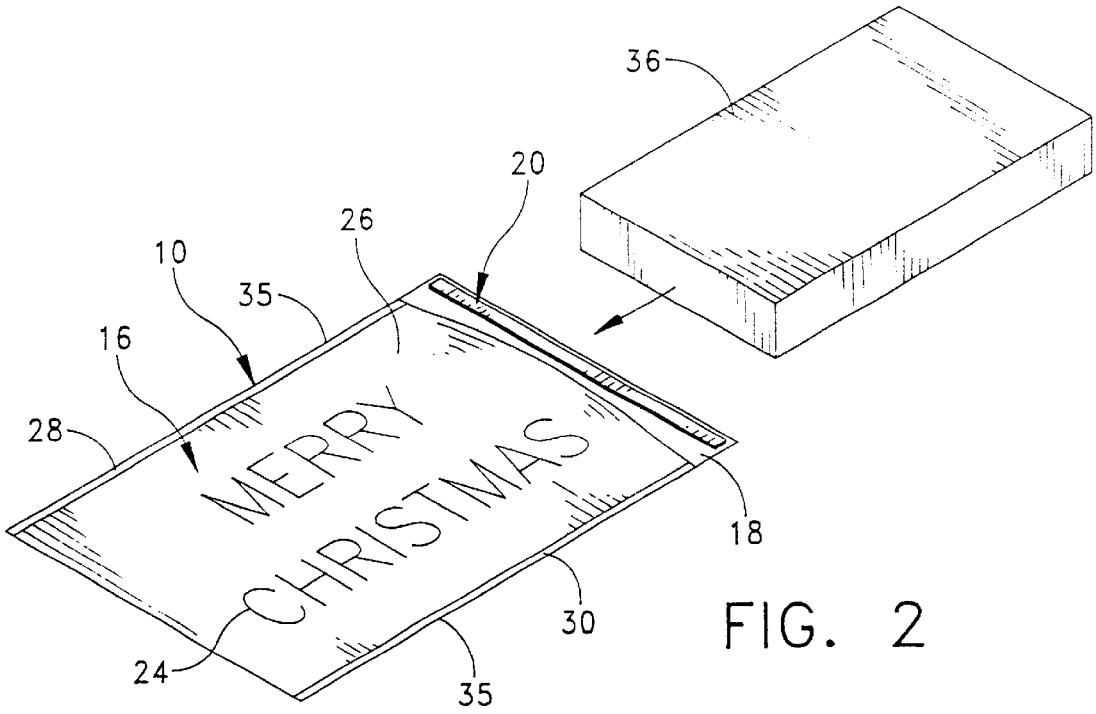
FIG. 2 is another perspective view of the shrink wrap gift bag with a gift box partially inserted therein.
Figure 3:
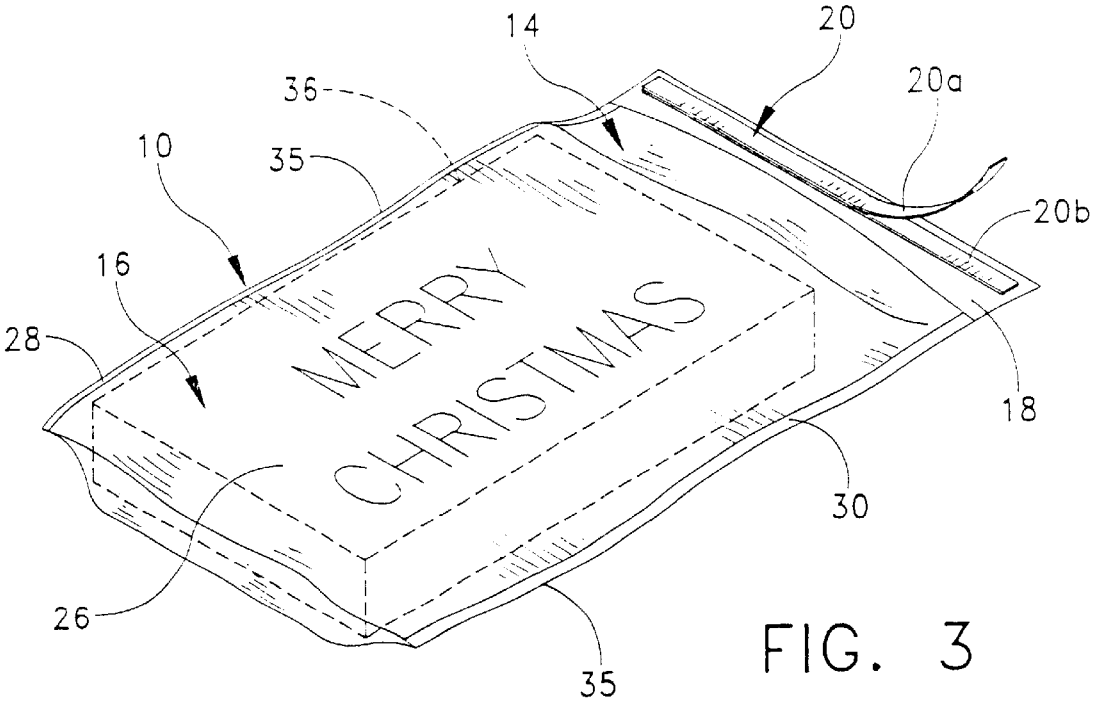
FIG. 3 is a another perspective view thereof with the gift box fully inserted and the tape being removed to seal to bag closed.
Figure 4:
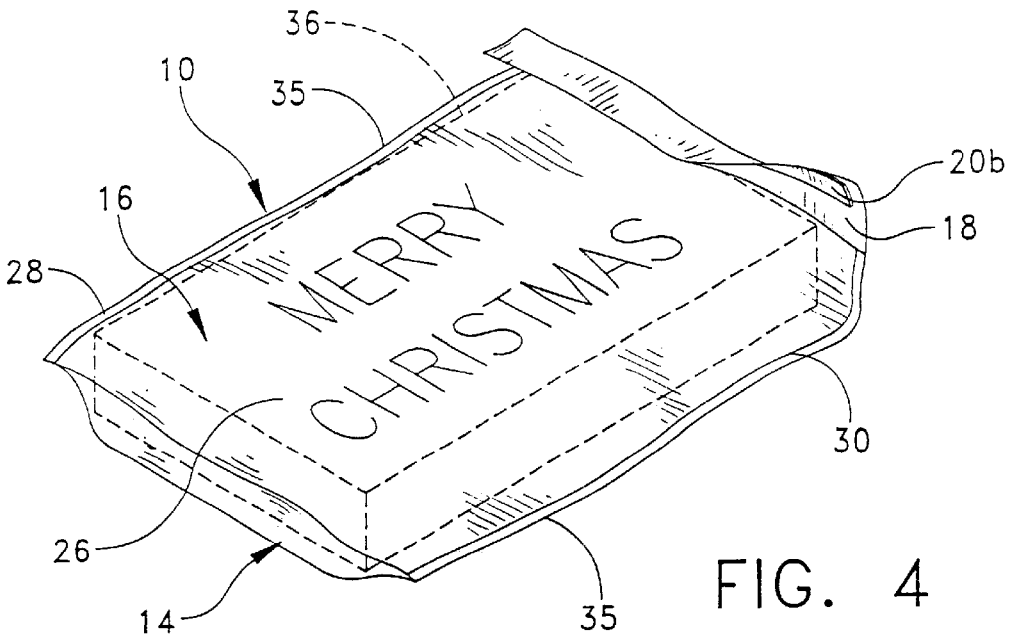
FIG. 4 is yet another perspective view thereof with the gift box fully inserted and the closure lip being folded over and sealed.
Figure 5:
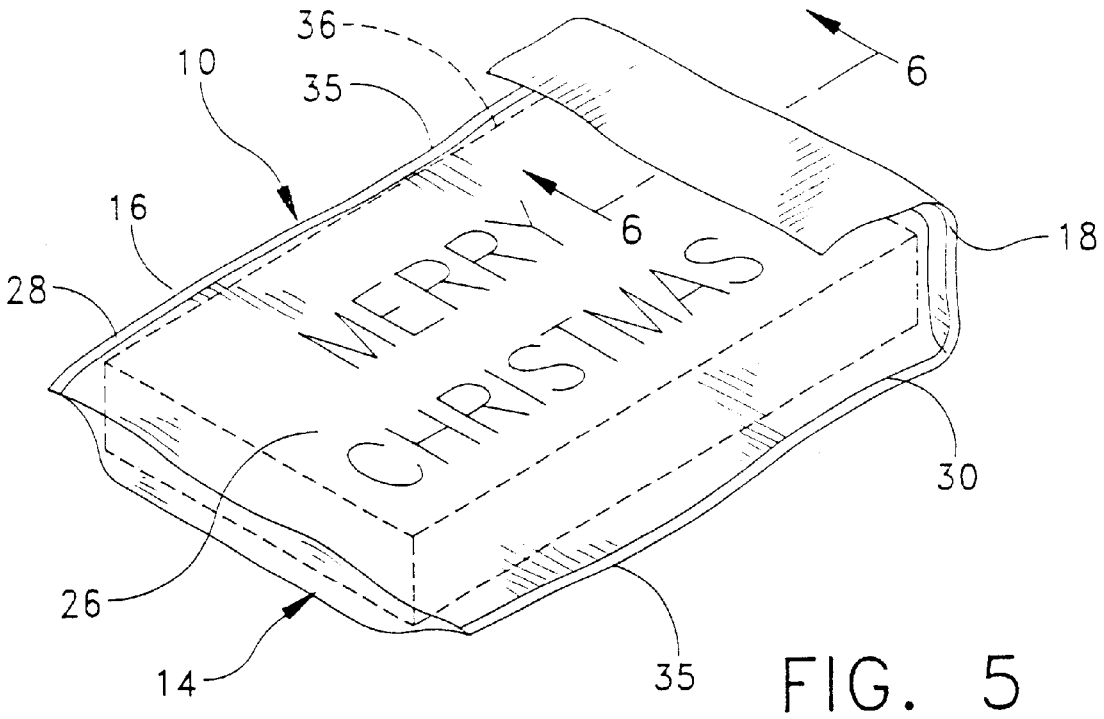
FIG. 5 is a another perspective view thereof with the bag completely sealed.
Figure 6:
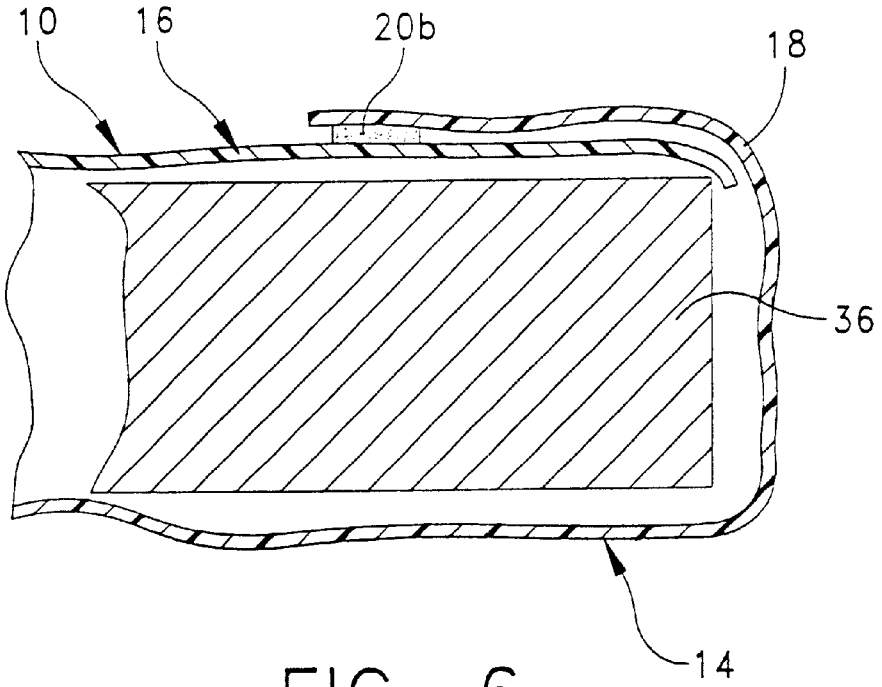
FIG. 6 is a cross-sectional view thereof as taken along line 6—6 of FIG. 5.
Figure 7:
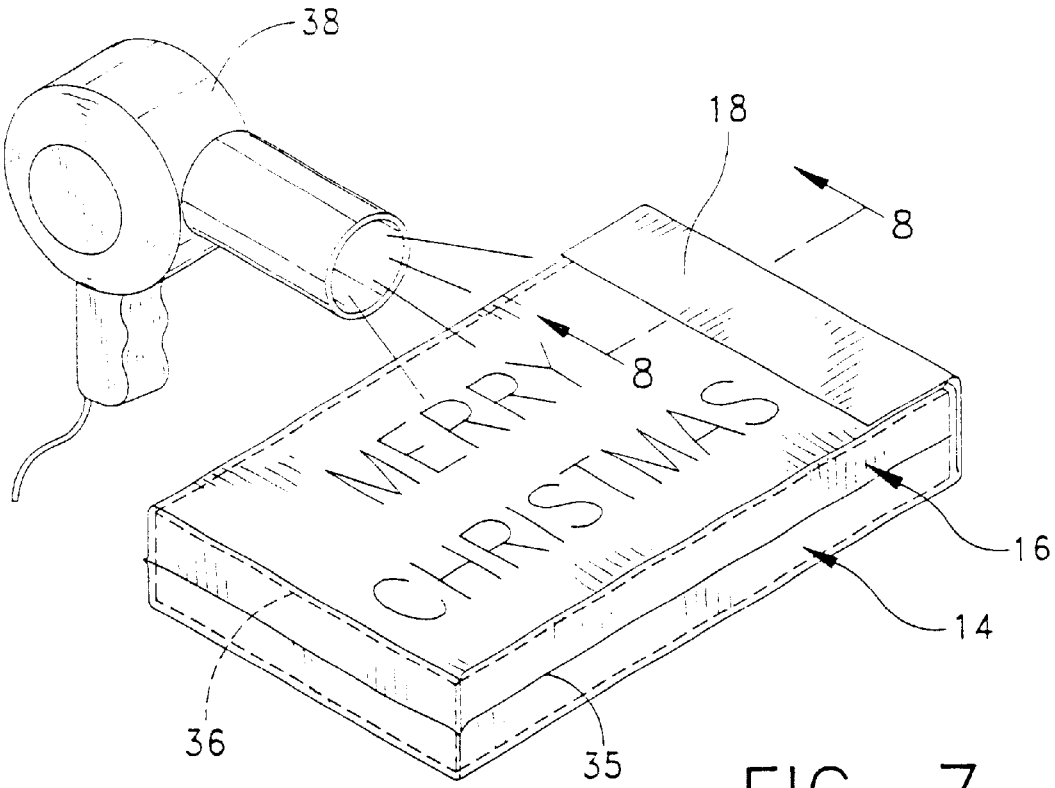
FIG. 7 is another perspective view thereof showing the application of hot air from a conventional home hair dryer.
Figure 8:
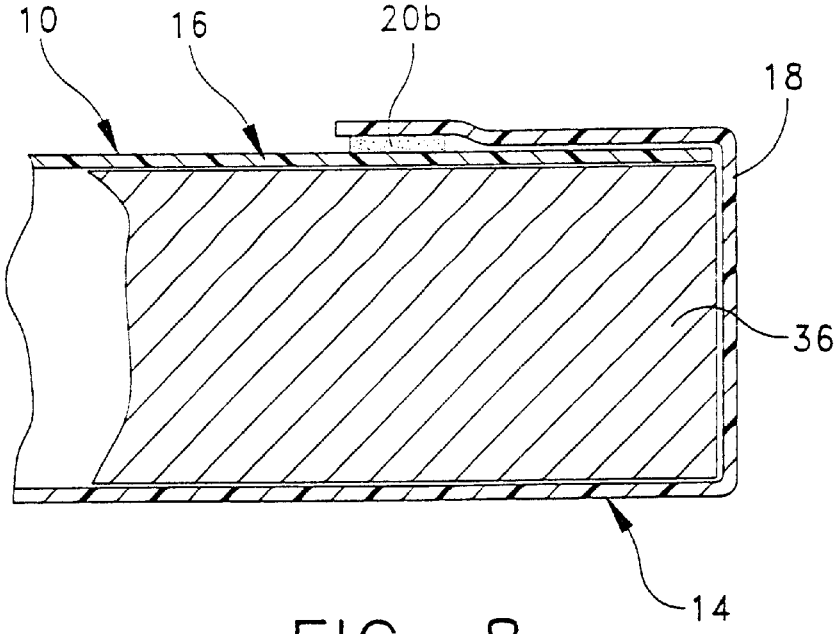
FIG. 8 is a cross-sectional view thereof as taken along line 8—8 of FIG. 7, showing the finished product.
Figure 9:
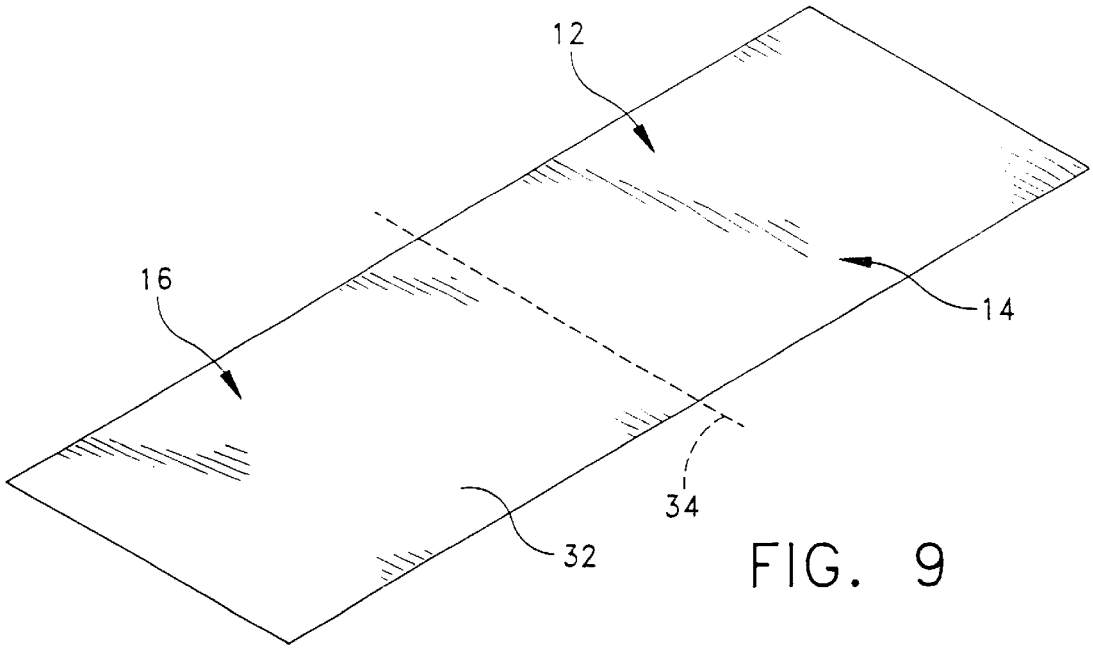
FIG. 9 is a perspective view of the inner surface of a sheet of plastic film as used to form the gift bag shown in FIG. 1.
Figure 10:
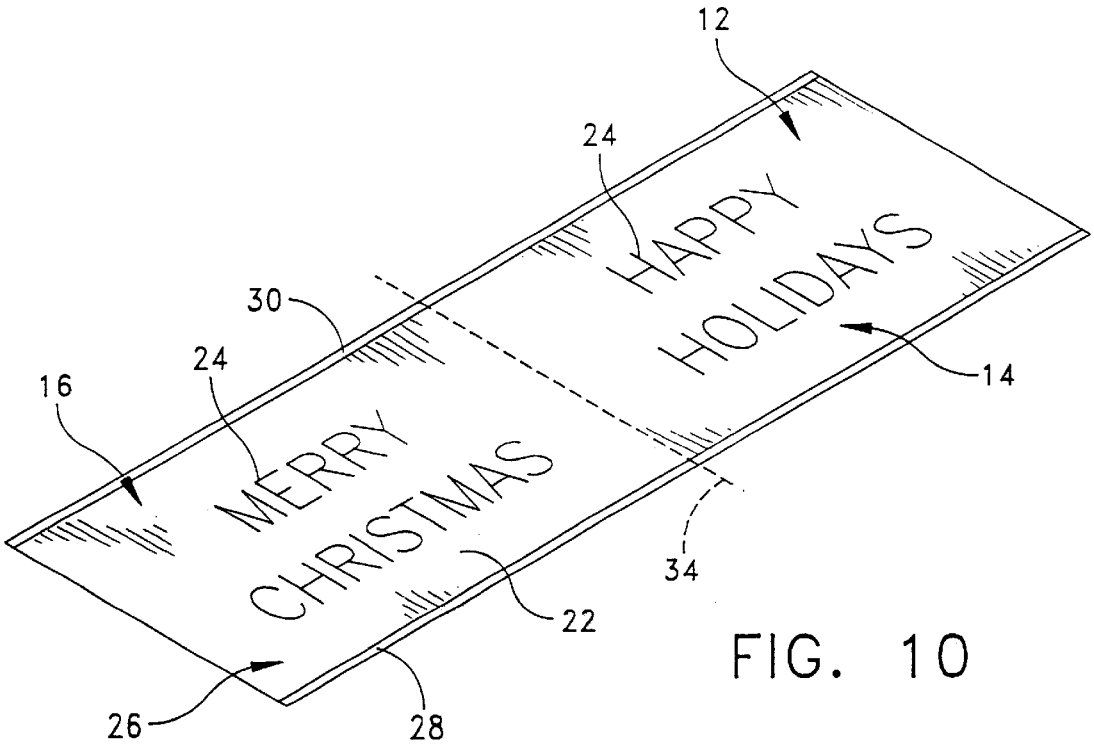
FIG. 10 is a perspective view of the outer surface thereof.
Figure 11:
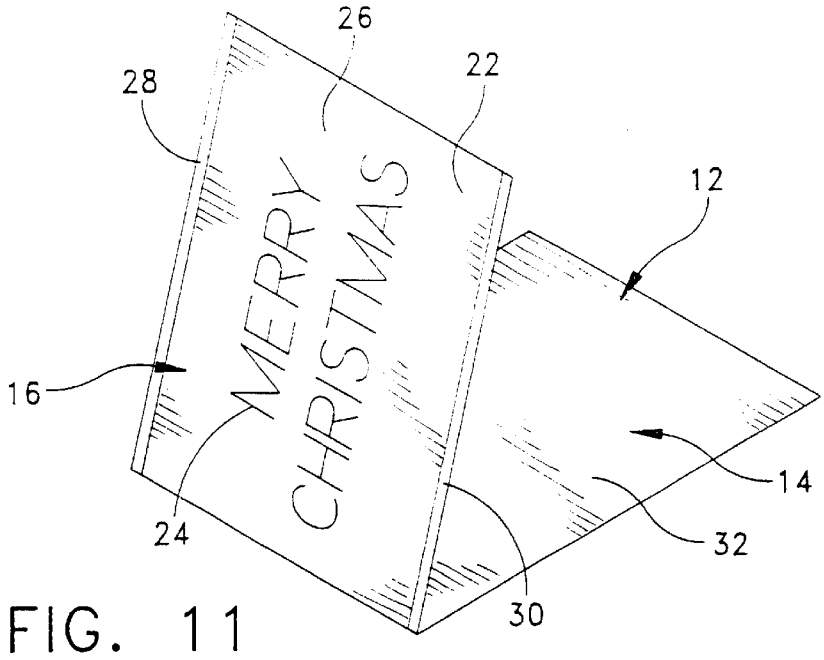
FIG. 11 is yet another perspective view showing the sheet being folded along a transverse fold line to form the bag.
Figure 12:
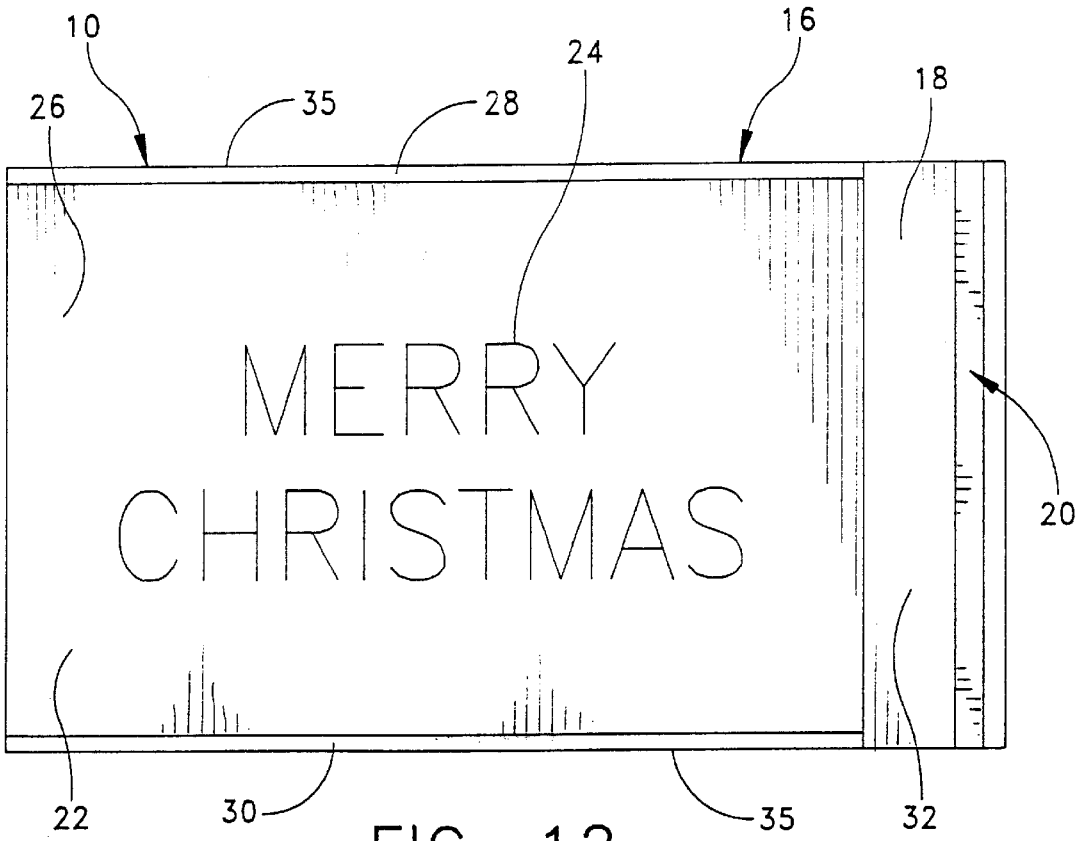
FIG. 12 is yet another perspective view of the bag in folded, the side edge welded together and the adhesive strip applied to the lip of the bag.

In use, the gift bags 10 can be sold in a kit including several of the same, or several different sizes of bags which will be sized to accommodate a variety of different standard size gifts or gift boxes. Standard box sizes which are contemplated include, but are not limited to, a standard tie box, standard shirt box, video tape, compact disc, and wine bottle. The user would select the appropriate size gift bag 10 for use (FIG. 1) and then slide the gift 36 into the bag 10 (FIG. 2). The backing 20*a* of the tape strip 20 is then removed (FIG. 3) and the lip 18 folded over and sealed to the front bag panel 16 (FIG. 4) so that the majority of the slack of material is taken up (FIG. 5). The user then applies heat to the entire package by waving a conventional home hair dryer 38 back and forth across the package (FIG. 7). The finished product is a neatly wrapped gift box.

EXAMPLE

Plastic Film

- Polyvinyl chloride resin (horizontally blown film process)
- 80–100 gauge thickness
- 30—30 Balanced Shrink Ratio Manufacturing Specifications

- Side weld bag forming Machine
- Seal Diameter—1/64 inch
- Seal Bar—Chrome Plated or Teflon Coated
- Seal Bar Pressure—50 psi
- Seal Temperature—700° F.
- Bag Lip—2 inches
- Adhesive Strip—3M brand HKC-71 Reclosable, Poly Backed It can therefore be seen that the present invention provides an improved shrink wrap gift bag that is specifically configured, sized and manufactured so that the bag closely conforms to the box when shrunk and provides a neat, aesthetically pleasing finished product. The use of a plastic that is formulated to shrink within a temperature range of a typical home hair dryer, and that is formulated with a balanced shrink ratio, provides a simple and effective wrapping system that can be easily completed at home with consistent uniform results. For these reason, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A heat shrinkable gift bag comprising:

a monolithic sheet of heat shrinkable opaque, polyvinyl chloride film, said sheet of heat shrinkable film having a gauge thickness of about 90 gauge, said sheet of heat shrinkable film having a balanced shrink ratio in x and y orientations of said film to provide a uniform and consistent shrink profile upon the application of heat thereto, said sheet of film having an activated shrink temperature of about 140° F., said sheet of heat shrinkable film having inner and outer surfaces, said sheet of heat shrinkable film having a decorative pattern printed on said outside surface, said heat shrinkable film being formed into a side-weld bag wherein said inner surface of said plastic film is folded over on itself along a transverse line to define a rear bag panel and a front bag panel, said front bag panel being shorter than said rear bag panel to thereby form an extended lip, said front and rear bag panels being welded along opposing side edges thereof to thereby provide a closed bottom end, closed side edges and an open top end forming a mouth of said heat shrinkable gift bag; and a self-adhesive strip disposed on said extended lip for use in closing the mouth of the bag.

2. The heat shrinkable gift bag of claim 1 wherein said self-adhesive strip comprises a non-shrinkable self-adhesive strip.

3. In combination, a gift box; and a heat shrinkable gift bag for enclosing said gift box, said heat shrinkable gift bag comprising a monolithic sheet of heat shrinkable opaque polyvinyl chloride film, said sheet of heat shrinkable film having a gauge thickness of about 90 gauge, said sheet of heat shrinkable film having a balanced shrink ratio in x and y orientations of said film to provide a uniform and consistent shrink profile upon the application of heat thereto, said sheet of film having an activated shrink temperature of about 140° F., said sheet of heat shrinkable film having inner and outer surfaces, said sheet of heat shrinkable film having a decorative pattern printed on said outside surface, said heat shrinkable plastic film being formed into a side-weld bag wherein said inner surface of said film is folded over on itself along a transverse line to define a rear bag panel and a front bag panel, said front bag panel being shorter than said rear bag panel to thereby form an extended lip, said front and rear bag panels being welded along opposing side edges thereof to thereby provide a closed bottom end, closed side edges and an open top end forming a mouth of said heat shrinkable gift bag, said heat shrinkable gift bag further comprising a self-adhesive strip disposed on said extended lip for use in closing the mouth of the bag, said gift box having predetermined dimensions, and said gift bag having corresponding predetermined dimensions which are about 20 percent larger than said dimensions of said gift box wherein said gift box can be loosely accommodated within said gift bag for wrapping thereof, said gift bag shrinking to snugly and tightly engage said gift box upon the application of heat thereto.

4. The combination of claim 3 wherein said self-adhesive strip comprises a non-shrinkable self-adhesive strip.

* * * * *